United States Patent [19]

Averette

[11] 4,164,885

[45] Aug. 21, 1979

[54] LIFTS FOR PEDALS OF MUSICAL INSTRUMENTS

[76] Inventor: Thomas P. Averette, 14277 Bochee Rd., Apple Valley, Calif. 92307

[21] Appl. No.: 847,839

[22] Filed: Nov. 2, 1977

[51] Int. Cl.[2] ..... G10C 3/26

[52] U.S. Cl. ..... 84/231; 74/562

[58] Field of Search ..... 84/230-232, 84/358, 426; 74/562, 562.5

[56] References Cited

U.S. PATENT DOCUMENTS

| | | | |
|---|---|---|---|
| 489,810 | 1/1893 | Hobday | 84/231 |
| 839,276 | 12/1906 | Drew | 84/231 |

*Primary Examiner*—John Gonzales

*Attorney, Agent, or Firm*—Donald D. Mon

[57] ABSTRACT

A foot pedal of a console type musical instrument is provided with a lift attachable to the pedal to raise its effective height for the benefit of small people such as children. The lift is a member to be placed on top of the foot block of the pedal and is attached to the pedal by a U-shaped bracket which passes beneath the pedal and has sides which extend upwardly to a position of attachment to the lift. Provision is made for tensioning the sides of the bracket which may be done by a camming surface on the lift or by bowing the bracket sides. Provision is also made for preventing twisting of the lift on the pedal.

10 Claims, 26 Drawing Figures

LIFTS FOR PEDALS OF MUSICAL INSTRUMENTS

This invention relates to lifts for pedals by which musical instruments are played.

Musical instruments played by foot pedals are well known, notably spinet and console-type organs. According to common practice such pedals protrude toward the feet of the person playing it. Ordinarily there are relatively long or major pedals for playing certain notes and relatively shorter minor pedals located between the longer pedals for playing different notes. Such pedals commonly are provided with pedal blocks to which pressure is applied by the foot to depress the pedal. The blocks of the shorter pedals generally are raised higher than the blocks of the longer pedals so that a shorter pedal may be depressed without depressing a longer pedal. Likewise the additional length of the longer pedal enables it to be depressed without depressing a shorter pedal. The pedals and their blocks are usually of such a height as to comfortably accommodate the leg length of an average sized adult sitting at the console. Such length, however, does not comfortably accommodate the leg length of a child or other small person.

It is an object of the present invention to provide readily attachable lifts to the pedals so that the leg length of a smaller person may be confortably accommodated.

The invention is carried out by use of a lift shaped and dimensioned to be fitted on top of the usual pedal block. A feature is the use of a generally U-shaped bracket which can be passed upward from beneath the pedal to a position where it is attachable to the lift. A further feature resides in means for applying tension to the sides of the bracket so as to securely hold the lift to the top of the pedal block. A further feature resides in means for holding the lift against twisting relative to the pedal.

A feature of some embodiments of the invention resides in the use of a J-hook attached to the lift and adapted to hook beneath the rear of the pedal. This securely holds the lift on the pedal and prevents the twisting. Another feature in some embodiments is the provision of a surface of the lift shaped to come into contact with the upper surface of the block and to provide a camming effect which produces the tension of the bracket.

In another embodiment a feature resides in means for bowing the side walls of the bracket to produce the tension.

According to one embodiment the lift is recessed to fit down over the sides of the block to which it is to be fitted, thereby preventing twist of the lift relative to the block.

The foregoing and other features of the invention will be better understood from the following detailed description and the accompanying drawings of which:

Figure 1:
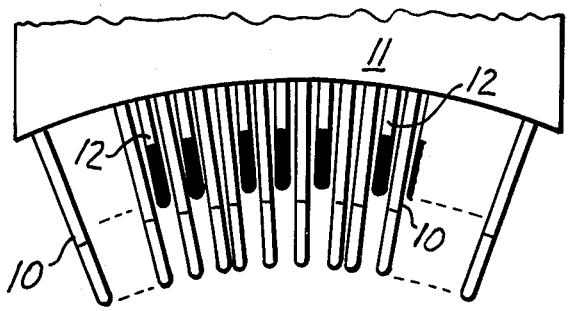
FIG. 1 shows part of an organ with a top view of organ pedals to which lifts may be applied according to this invention.

Referring to the drawings, FIG. 1 is a plan view showing part of the foot pedal mechanism of a type of organ. According to a known practice there are a plurality of spaced major or long foot pedals 10 extending outward from a housing 11 and extending toward a seat (not shown) for the operator. In the spaces between the long pedals 10 there are, according to common practice, a plurality of short or minor pedals 12. Each of these pedals is arranged relative to the housing so that it may be depressed by pressure from the foot.

Figure 2:
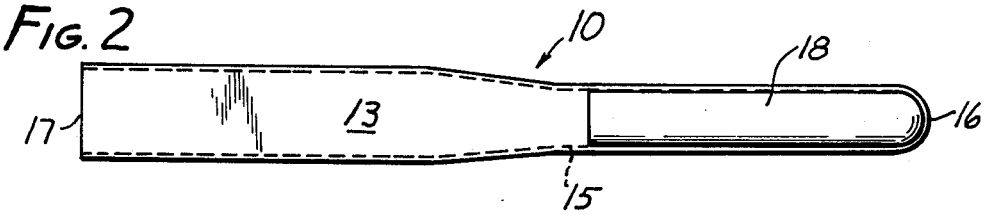
FIG. 2 is a plan view of one of the organ pedals.
Figure 3:
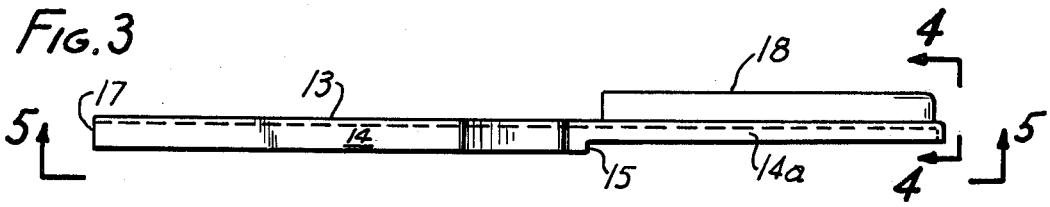
FIG. 3 is an elevation view of the organ pedal of FIG. 2.
Figure 6:
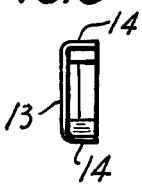
FIG. 6 is an end view looking from line 6—6 of FIG. 5.
Figure 5:
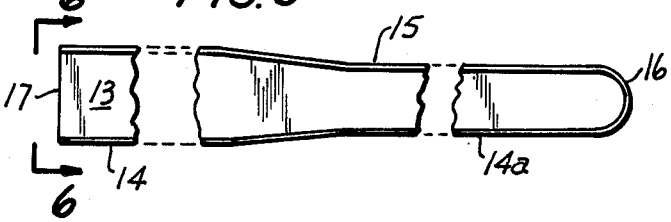
FIG. 5 is a bottom view looking from line 5—5 of FIG. 3.
Figure 4:
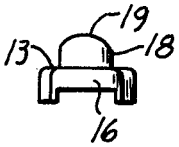
FIG. 4 is an end view looking from line 4—4 of FIG. 3.

FIGS. 2, 3, 4 and 5 illustrate the structure of a typical one of the long foot pedals 10. The foot pedal 10 comprises an elongated member commonly of metal with a U-shaped cross section as best seen in FIG. 6. It is assembled at the housing with the sides 14 of the U depending downwardly from its flat top 13. At an intermediate position 15 in its length, the height of sides 14 decreases to a lesser height **14*a* as best seen in FIG. 3. At its outer end, which is the end furthest removed from the housing, the sides are closed by the rounded end portion 16. At the region 15 the height of the side walls of the U member not only decreases, but also the side walls become closer to each other toward the outer end as seen in FIGS. 2 and 5. According to a common practice a block 18, ordinarily of wood, of a length approximately, or almost, equal to the length of side section 14*a*, and provided with a rounded top 19 for foot comfort, is attached to the top 13** of the U-member.

This is to provide a comfortable base for pressure by the foot. The height of foot block 18 off the floor is ordinarily such as to accommodate the length of the legs of an adult who is to operate the organ. The foot block, however, is usually situated too low for the foot of a small person or child to reach.

Figure 9:
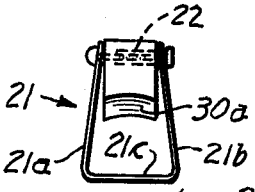
FIG. 9 is a front end view of the lift of FIGS. 7 and 8.
Figure 7:
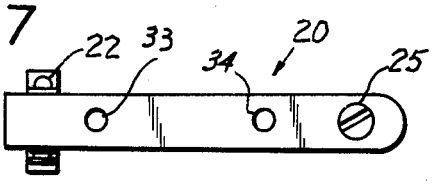
FIG. 7 is a plan view of a lift which may be applied to the pedal of FIGS. 2 through 6.
Figure 8:
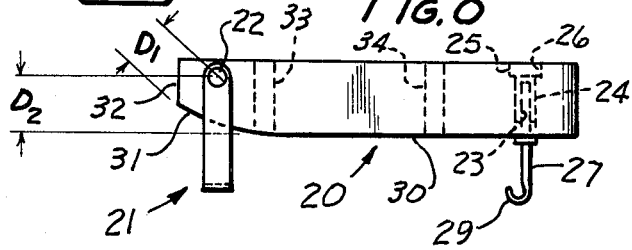
FIG. 8 is an elevation view of the lift shown in FIG. 7.
Figure 8:
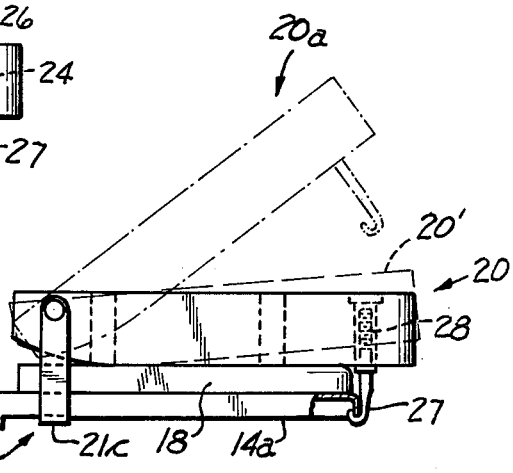

According to the present invention there is provided a lift 20, shown in FIGS. 7, 8 and 9, which can easily and quickly be attached to the foot pedal to enable a small person or child to operate the pedal. The lift 20 is in the form of a block, which may be made of wood, having a length somewhat greater than the length of block 18 and a width approximately equal to the width of block 18. Its height will usually be greater than the height of block 18 and will be such as may be considered proper to raise the effective height of the pedal to that which will comfortably accommodate the foot of the person who is to operate the organ.

At a position near the forward end of the block a U-shaped bracket 21 is pivotally attached to the lift 20. For this purpose, a pivot bolt 22 or the like, passes through a hole through the lift in a direction transverse to the longer length of the lift and extends from both sides of the lift. The side members 21*a* and 21*b* of the bracket 21 pivot on the respective protruding ends of pin 22.

At a position near the rear end of the lift a vertical hole 23 passes through the lift from top to bottom through which there passes the internally threaded hollow sleeve 24 provided with a slotted head 25 of greater diameter than that of the shank, which fits into a recess 26 formed in the top of the lift. A J-hook 27 has a threaded shank 28 the upper end of which threads into the sleeve 24 and the lower end of which is provided with a hook portion 29.

The under surface 30 of the lift is provided with a concave curvature 30*a*, seen in FIG. 9, shaped to conform with the convex curvature of the upper surface 19 of block 18. The forward under surface of the lift 20 is provided with a rounded form 31 as seen from the side (FIG. 8). This rounded portion also includes the concavity 30*a* illustrated in FIG. 9 although the concavity at this position is not essential. The rounding 31 is such that the distance D1 from the axis of the pivot 22 to a position of this rounded portion which is adjacent the forward end 32 of the lift is less than the distance D2 from the axis to a line which is an extension of the bottom 30 of the lift.

Figure 10:
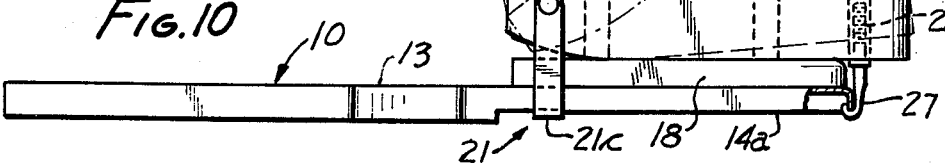
FIG. 10 shows the lift of FIGS. 7 through 9 applied to the pedal of FIGS. 2 through 6.

The lift 20 is attached to the pedal as illustrated in FIG. 10. The lift will be moved over the pedal from the rear such that the lift will be on top of the block 18 while the base 21*c* of the bracket 21 is beneath the rear part 14*a* of the pedal. This is best done by tilting the lift to its position shown in dotted lines 20*a* in FIG. 10. By swinging the bracket 21 to its position shown in FIG. 10 which can be at or nearly over the forward end of the lift, the lift can be readily moved forwardly over the top of block 18 to its position shown in FIG. 10. By applying moderate downward pressure on the rear end of the lift, the bottom surface of the lift may be made to lie flush with the upper surface of the block 18 as shown in full lines in FIG. 10. In this position the J-hook 27 can be hooked beneath the depending lip formed by the rear portion 16 of the pedal. Applying a screwdriver to the slotted head 25 of sleeve 24 will easily hold the lift flush with the top of the block 18.

It is seen that the effect of the difference between dimensions D-1 and D-2 is to produce a camming action along the rounded portion 31. Thus as the lift, after being placed on the block 18, is rotated clockwise from its dotted line position 20*a* in FIG. 10 toward the full line position shown in that figure, the rounded portion 31 comes into contact with the top of the block and as the clockwise rotation progresses, the position of the contact of surface 31 with the top of the block moves rearwardly. This exerts an upward pull on bracket 21 so that the side walls 21*a* and 21*b* are subjected to increasing tension between the bottom wall 21*c* and the pivot 22. This tension continues to increase until the lift is brought down flush against the block as shown in the full-line position of the lift in FIG. 10. When the lift has been pivoted to the position shown in broken lines at 20, the bracket is already under some tension, so that when the full-line position is reached, the bracket is under full tension. Thus, when the J-hook 27 is secured beneath the lip of the rear portion 16 of the pedal, the lift is firmly attached to the block and it cannot twist relative to the pedal.

Figure 11:
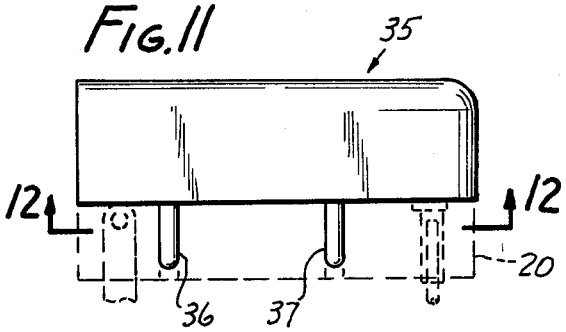
FIG. 11 is an elevation view and FIG. 12 a top view of a supplemental lift which may be applied to the lift shown in FIGS. 7 through 10.
Figure 12:
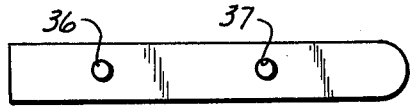

According to a preferred feature, the lift 20 is provided with a pair of holes 33 and 34 passing vertically through it. The purpose of these holes is for application of a supplemental lift, if desired, according to the size of the child or small person. Such a supplemental lift is shown in FIGS. 11 and 12. This is in the form of a member 35 of substantially rectangular cross section having a length approximately equal to the length of lift 20 and a width substantially equal to the width of lift 20 and of such height as may be desired to fit the person. There are fitted into the under surface of member 35 a pair of dowels 36 and 37 spaced according to the spacing of holes 33 and 34 into which they fit. When so fitted, the height of lift 20 is effectively increased by the height of supplemental lift 35.

Figure 13:
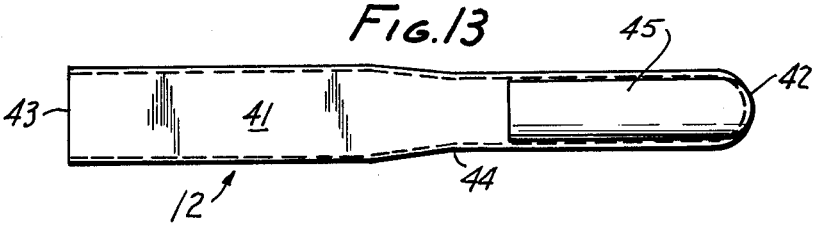
FIG. 13 is a plan view and FIG. 14 and end view of a shorter organ pedal than that shown in FIGS. 1 and 2.
Figure 14:
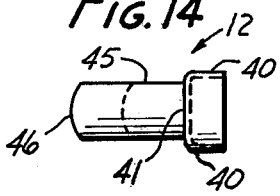
Figure 15:
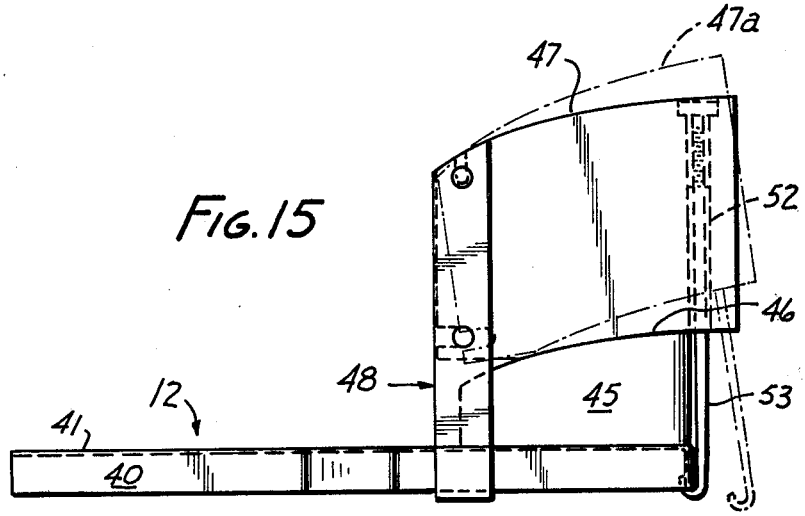
FIG. 15 shows a lift fitted to the pedal of FIGS. 13 and 14.

In FIGS. 13, 14 and 15 there is shown the structure of one of the short or minor foot pedals 12. This foot pedal 12 comprises an elongated member ordinarily of metal with a U-shaped cross section. It is assembled at the housing with the sides 40 of the U depending downwardly from its flat top 41. At its end furthest removed from the housing, the sides are closed by the rounded end portion 42. At an intermediate region 44 between its ends, the side walls become closer to each other as they approach the outer end 42 as seen in FIG. 13. According to a common practice a foot block 45, ordinarily of wood, of a length almost equal to the distance between rounded end 42 and intermediate position 44, and provided with a rounded top 46 for foot comfort, is attached to the top 41 of the U-member. It is seen that the short pedal 12 is constructed quite similar to the construction of the long pedal 10, although the short pedal is of shorter length and its block 45 is higher as compared with the length and height of block 18 of the long pedal, so that the foot of the user may depress a short pedal without depressing a long pedal.

Figure 17:
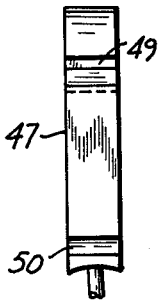
FIG. 17 is an end view looking from line 17—17 of FIG. 16.
Figure 16:
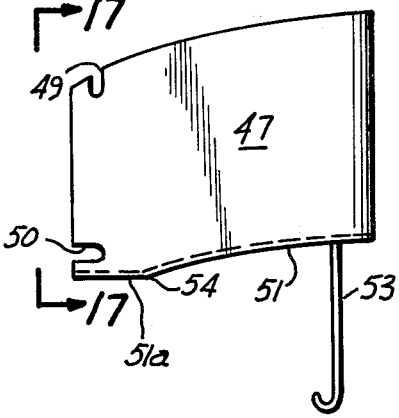
FIG. 16 is an elevation view of the lift shown in FIG. 15.

As shown in FIG. 15 a lift 47 can be attached to the foot pedal 12 for the benefit of a small person. The lift 47 is in the form of a member, which may be made of wood, illustrated in FIGS. 16 and 17. The lift has a length somewhat greater than that of block 45 and a width approximately equal to the width of block 45. Its height will be such as may be considered sufficient to raise the effective height of the pedal to that which will comfortably accommodate the operator of the organ.

Figure 18:
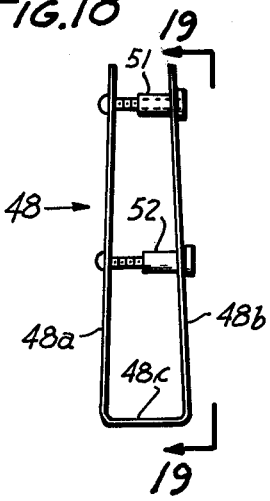
FIG. 18 is an end view of a bracket used with the lift of FIGS. 16 and 17.
Figure 19:
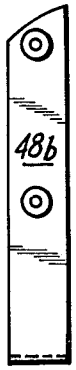
FIG. 19 is a side elevation view of the bracket looking from line 19—19 of FIG. 18.

For the purpose of receiving a bracket, 48 illustrated in FIGS. 18 and 19 a slot 49 extends downwardly from the top of the lift for a short distance, and a somewhat similar slot 50 extends rearwardly for a short distance from the forward edge of the lift. The bracket 48 is U-shaped, having side walls 48a and 48b and a bottom wall 48c. Two bolt pivots 51 and 52, which may be similar to the pivot 22 shown in FIG. 9, extend laterally between the sides 48a and 48b. The upper pivot 51 is placed near the top of the side walls of the bracket and the spacing between the pivots is such that the upper pivot 51 may be fitted within the upper slot 49 of lift 47 while the lower pivot 52 may be inserted within slot 50. The lower surface of the lift 47 has a section 51 provided with a curvature conforming with the curvature of the top of the upper surface 46 of the block 45. A forward section 51a of the lower surface of the lift extends approximately straight and horizontally as compared with the section 51 which extends somewhat upwardly and toward the rear in conformity with surfce 46. Both sections 51 and 51a of the lower lift surface are made concave in conformity with the convexity of the upper block surface 46. Near the rear end of the lift a hole 52 extends vertically from top to bottom to accommodate a J-hook which is similar to the J-hook 27 shown in FIGS. 8 and 10 in that it has a shank which threads into a sleeve at its upper end and is provided with a hook portion at its lower end. The sleeve is provided with a slotted head which threads into a recess at the top of the lift in the same manner as shown in FIGS. 8 and 10.

The lift 47 can readily be fitted to the pedal and its block by use of the bracket 48 and the J-hook 53. This can readily be done by inserting the upper pivot 51 in the slot 49 so that the lower pivot 52 is ready to enter the slot 50. The bottom wall 48c of the bracket can be slipped beneath the pedal 12 while the rear part of the lift is tilted upwardly off the block as shown in broken lines 47a in FIG. 15. After positioning the bracket at the forward end of the lift with the sidewalls 48a and 48b of the bracket extending up opposite sides of the pedal and block, the rear of the lift can be pushed downwardly to rotate the lift on upper pivot 51 until the rear section 51 of the lift is brought down flush against the upper surface of block 45 as shown in full lines in FIG. 15. As this operation is done, the lower slot 50 will move forwardly to receive pivot 52 and as the lift continues to rotate clockwise it will pivot on the upper surface 46 of the block at position 54 of the lift, inasmuch as the forward section 51a of the lower lift surface will be raised above the surface of the block. Thus as the lift is moved into its flush position against the top of the block, the slot 49 tends to move upwardly and it strains the sidewalls 48a and 48b of the bracket in tension between pivot 51 and lower wall 48c. In this position the hook of the J-bolt 53 is hooked beneath the rear end of the pedal as in the case of FIG. 10 and can then be tightened by a screwdriver applied to the slotted head of the sleeve of the J-bolt. The lift is now firmly and securely attached.

Figure 20:
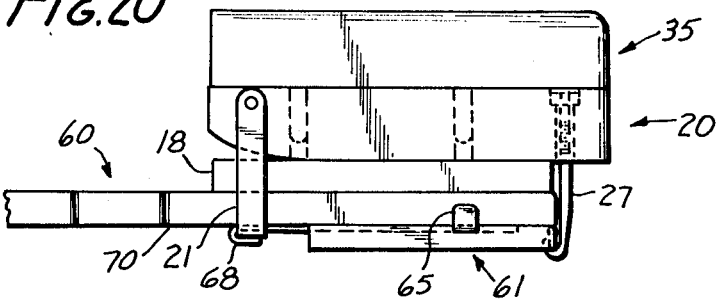
FIG. 20 shows the lift of FIGS. 7 through 9 applied to a different form of pedal from that shown in FIGS. 2 and 3.
Figure 21:
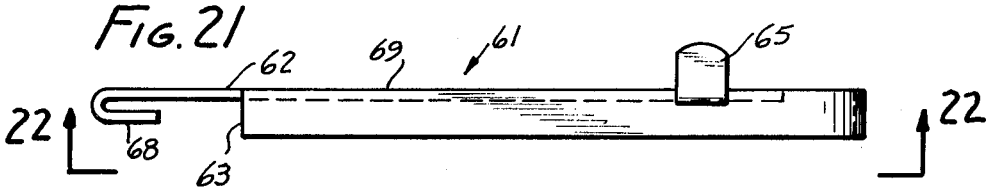
FIG. 21 is an elevation view of a fitting used in securing the lift of FIG. 20 to the pedal.
Figure 22:
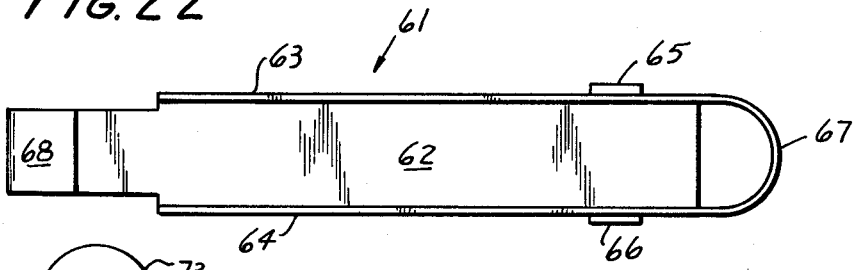
FIG. 22 is a bottom view of the fitting of FIG. 21, looking from line 22—22 of FIG. 21.
Figure 24:
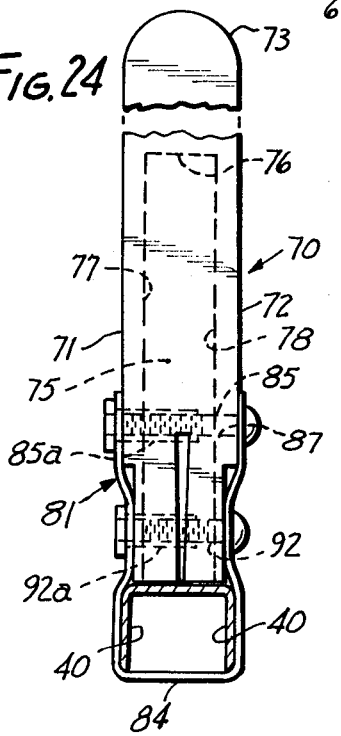
FIG. 24 is a view looking from line 24—24 of FIG. 23.
Figure 25:
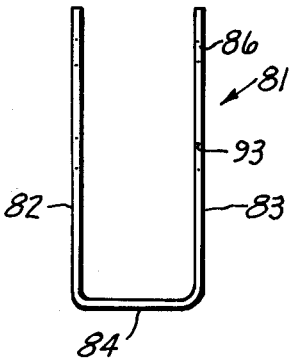
FIG. 25 is an end view of a bracket used with the structure of FIGS. 23 and 24.
Figure 26:
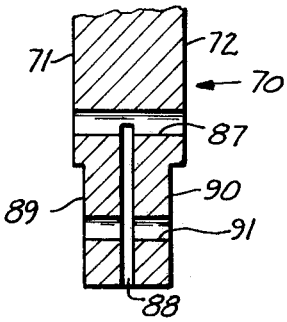
FIG. 26 shows a detail in cross section taken at line 26—26 of FIG. 23.

FIGS. 20 to 22 illustrate the use of a lift 20 such as that shown in FIGS. 8 and 10 in a situation where the pedal has no depending lip at the rear such as that formed by the rear portion 16 of the pedal shown in FIG. 10. In FIG. 20 the pedal 60 is similar to the pedal of FIG. 10 except that the pedal is a strip of uniform thickness from front to back and has no depending lip which could be engaged by a J-hook. To permit the attachment of the lift 20, which is constructed the same as the lift 20 shown in FIG. 10 there is provided a member 61 illustrated in FIGS. 21 and 22. The member 61 comprises a flat strip 62, preferably of metal, having depending sides 63 and 64 to provide rigidity, and a pair of ears 65 and 66 upstanding from the respective sides 63 and 64. At the rear, the sides 63 and 64 join each other in a loop 67 which forms a depending lip at the rear. At the forward end the strip 62 is formed into a hook 68 positioned beneath the top of strip 62.

The member 61 is dimensioned so that when the top surface 69 of the strip is placed substantially flush against the bottom surface 70 of the pedal the ears 65 and 66 extend upwardly against the opposite sides of the pedal as shown in FIG. 20, and the rounded end 67 will be at the rear of the pedal block 18, and the hook member 68 will be located below the U-shaped bracket 21. While the member 61 is thus held to the bottom of the pedal the lift 20 will be applied in much the same manner as described in connection with FIG. 10, so that the bottom surface of the bracket is brought forwardly within the hook 68. Then when the lift is cammed downward at the rear the J-hook 27 is hooked beneath the depending lip of rounded end 67. This camming action puts the sides of the bracket in tension as described in connection with FIG. 10. The ears 65 and 66 prevent sidewise movement of strip 61 and the lift relative to the pedal. In FIG. 20 the supplemental lift 35 is included, as in FIG. 11, although its use is optional and dependent on the size of the person. FIGS. 23 through 26 illustrate the application of a lift to a minor foot pedal, which is an alternative to the arrangement shown in FIGS. 13 through 19. The pedal 12 and its block 45 are the same as in FIG. 15. The lift 70, however, is different from the lift 47 shown in FIG. 15. The lift 70 has opposite sides 71 and 72 which are rectangular in shape and the lift is preferably rounded at the top 73. The base 74 is flat. There is formed within the lift a recess 75 which opens at the base 74 and extends upwardly to a top wall 76 of the recess. The side walls 77 and 78 of the recess are parallel and vertical and spaced from each other by a distance which enables the side walls of the lift to come down over the side walls of the block 45. The end walls 79 and 80 of the recess are vertical and parallel to each other and spaced by the distance which enables them to come down over the end walls of block 45. Thus, the lift can be brought down over the block until the base 74 of the lift is flush with the top of the pedal.

For the purpose of securing the lift to the pedal there is provided a U-shaped bracket 81 having sides 82 and 83 and a base 84. The bracket is held to the lift by bolt 85 and sleeve 85a passed through opposite holes 86 through the sides of the bracket and through a hole 87 through the lift. The bolt arrangement is similar to the pivot bolts used in previously described embodiments.

A feature of the presently described embodiment resides in the means for tensioning the sides of the bracket to draw the bracket base 84 up tight against the bottom of the pedal. For this purpose the forward wall of the lift is provided with a slot 88 extending upwardly from the base to the hole 87, so that the slot bifurcates this forward wall.

A further preferred feature resides in the provision of indentions 89 and 90 of the respective walls 71 and 72 so that the distance between the indented walls 89 and 90 is less than the width between walls 71 and 72. A bore 91 parallel to bore 87 is passed through the lift at the region of the indented wall portions 89 and 90 so that bore 91 crosses the slot 88. A bolt 92, similar to bolt 85 in that it has a sleeve 92a into which the bolt threads, passes through bore 91 and holes 93 through the sides of the bracket.

Figure 23:
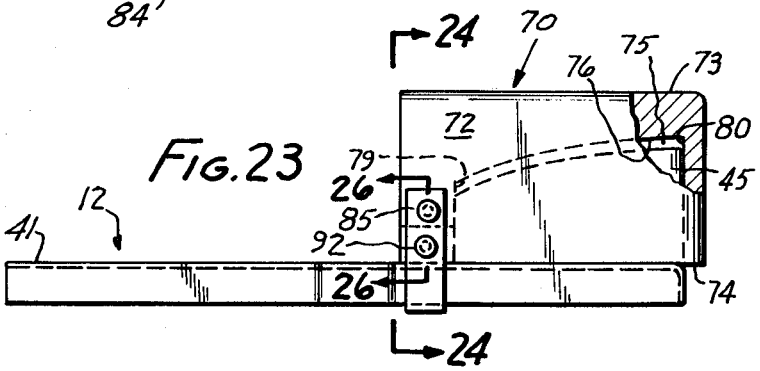
FIG. 23 shows the pedal of FIGS. 13 and 14 fitted with a different form of lift from that shown in FIG. 15.

The bracket 81 is attached to the lift by passing the sleeve bolts 85 and 92 through their respective holes through the bracket and of the lift after the lift is placed over the block 45 as shown in FIG. 23. The bolt 85 will then be tightened, but before the bolt 92 is tightened the side walls of the bracket will not be tensioned. It is seen that this untensioned status of the bracket has readily permitted the assembly of bolt 85 with the bracket and lift. In order to tension the bracket walls, the bolt 92 will then be tightened by threading it further into its sleeve 92*a*. This will have the effect of bending the bracket side walls 82 and 83 inward from their parallel positions shown in FIG. 25. The side walls can be brought inward until they are flush with the wall portions 89 and 90 at the region of bore 91. Also, tightening of the bolt 92 has the effect of closing the distance between the walls of slot 88 at the region of bore 91 so that the side walls of the bracket bend even further inward. This inward bending of the bracket walls 82 and 83 has the effect of drawing the bottom wall 84 of the bracket up tightly against the bottom of the pedal and at the same time tensioning the bracket side walls. Not only is the lift held tightly to the pedal but also it is prevented from twisting by reason of the fact that its inner side walls 77 and 78 are snug against the sides of block 45.

Although the embodiments illustrated and described herein have particular reference to pedals which protrude rearwardly from an organ housing it should be understood that the invention is applicable as well to other organ arrangements, such as for example the type in which the pedals extend forwardly toward the organ housing from a more rearward position.

This invention is not to be limited by the embodiments shown in the drawings and described in the description, which are given by way of example and not of limitation, but only in accordance with the scope of the appended claims.

I claim:

1. A lift for a depressable foot pedal of the type having an elongated member with a foot block on its upper surface, said lift comprising:

a body dimensioned to be positioned on the top of the block;

a U-shaped bracket having a base adapted to pass beneath the elongated member, and having a pair of side members adapted to extend upwardly from the base along opposite sides of the member and the block;

means adapted to attach the side members to a front part of the body, this means comprising bolt means; and means adapted to tension the side members between the base and said front part of the body, thereby securing the body on the top of the block, this said means comprising a cam surface at the forward underside of the body adapted to cam on the upper surface of the block, and a J-hook attached to a rear part of the body and adapted to hook beneath the rear part of the elongated member.

2. A lift according to claim 1 in which the top of the block is convex and the bottom of the body is concave to conform with the top of the block.

3. A lift according to claim 2 including means for attaching a supplemental lift to the top of the body.

4. A lift according to claim 1 in which the bolt means extends between the side members and a slot is formed in the top of a forward part of the body for receiving the bolt means.

5. A lift according to claim 4 in which a second bolt means extends between the side members at a position below the first-mentioned bolt means and a second slot is formed at a forward part of the body for receiving the second bolt means.

6. A lift according to claim 1 including a strip adapted to be placed beneath the elongated member, said strip having a hook for retaining the base of the bracket and a depending lip at the rear for attachment by the J-hook.

7. A lift according to claim 6 in which said strip has ears upstanding from opposite sides adapted to pass upwardly along the sides of the elongated member.

8. A lift for a depressable foot pedal of the type having an elongated member with a foot block on its upper surface, said lift comprising:

a body dimensioned to be positioned on the top of the block;

a U-shaped bracket having a base adapted to pass beneath the elongated member, and having a pair of side members adapted to extend upwardly from the base along opposite sides of the member and the block;

means adapted to tension the side members between the base and said front part of the body, thereby securing the body on the top of the block;

said means adapted to attach the side members to a front part of the body comprising a fastener extending between the side members, and a second fastener which extends between the side members which is adapted to bow the side members inwardly toward each other to tension them when the lift is applied to the elongated member;

the wall of the body being thinner at the region of the second fastener to facilitate the bowing of the side members.

9. A lift according to claim 8 in which the body is slotted at the region of the second fastener so that the second fastener can reduce the width of the slot.

10. A lift according to claim 9 in which the body contains a recess which accommodates the foot block.

* * * * *